US009758922B2

(12) United States Patent
Uchikoshi

(10) Patent No.: US 9,758,922 B2
(45) Date of Patent: Sep. 12, 2017

(54) MIDDLE IRON OF A TROUSER-PRESSING MACHINE AND A COVER FOR USE OF THE MIDDLE IRON

(71) Applicant: SANKOSYA Co., Ltd., Tokyo (JP)

(72) Inventor: Mitsuyuki Uchikoshi, Tokyo (JP)

(73) Assignee: SANKOSYA Co., Ltd., Tokyo (JP)

( * ) Notice: Subject to any disclaimer, the term of this patent is extended or adjusted under 35 U.S.C. 154(b) by 0 days.

(21) Appl. No.: 15/046,509

(22) Filed: Feb. 18, 2016

(65) Prior Publication Data

US 2016/0244908 A1 Aug. 25, 2016

(30) Foreign Application Priority Data

Feb. 19, 2015 (JP) ..... 2015-030276

(51) Int. Cl.
*D06F 71/36* (2006.01)
*D06F 71/29* (2006.01)

(52) U.S. Cl.
CPC ..... *D06F 71/36* (2013.01); *D06F 71/29* (2013.01); *D06F 71/295* (2013.01)

(58) Field of Classification Search
CPC ..... D06F 71/00–71/29; D06F 71/295; D06F 71/36; D06C 15/00
See application file for complete search history.

(56) References Cited

U.S. PATENT DOCUMENTS

| | | | | |
|---|---|---|---|---|
| 2,669,374 A * | 2/1954 | Jones | D06F 71/29 | 223/57 |
| 2,778,132 A * | 1/1957 | Posey | D06F 71/36 | 38/21 |
| 3,305,956 A * | 2/1967 | Fleischer | D06F 71/29 | 223/74 |
| 3,425,141 A | 2/1969 | Fuhring et al. | | |
| 3,722,115 A * | 3/1973 | Hanson | D06F 71/29 | 38/21 |
| 3,835,559 A * | 9/1974 | Kotter | D06F 71/29 | 223/73 |
| 4,819,350 A * | 4/1989 | Engel | D06F 71/29 | 38/30 |
| 5,711,097 A * | 1/1998 | Mino | D06F 71/29 | 223/73 |

* cited by examiner

*Primary Examiner* — Ismael Izaguirre
(74) *Attorney, Agent, or Firm* — Michael J. Feigin, Esq.; Fergin & Fridman

(57) ABSTRACT

The middle iron (3) is provided between the upper iron (1) and the lower iron (2). One of a trouser leg (4*a*) is set between the middle iron (3) and the lower iron (2) and the other of a trouser leg (4*b*) is set between the middle iron (3) and the upper iron (1). Both legs (4*a*, 4*b*) of the trouser (4) are held by the upper iron (1), the middle iron (3) and the lower iron (2) and pressed. This disclosure relates to the middle iron (3) such as the type of trouser-pressing machine. At the middle iron (3), in one side end part (3*a*) which the crotch (4*c*) of the trouser (4) setting on, only a portion (3*b*) corresponding to the crotch (4*c*) is formed to tapered shape gradually thinning toward the side of the middle iron (3).

5 Claims, 6 Drawing Sheets

MIDDLE IRON OF A TROUSER-PRESSING MACHINE AND A COVER FOR USE OF THE MIDDLE IRON

BACKGROUND OF THE INVENTION (1) Field of the Invention

This invention relates to a trouser-pressing machine.

More particularly, this invention relates to a middle iron used for setting a washed trouser and a cover used while covering over the middle iron.

(2) Description of the Related Art

In the prior art, as this type of trouser-pressing machine, there has been provided a machine descried in U.S. Pat. No. 3,425,141, for example. This prior art trouser-pressing machine is provided the middle iron for setting the trouser between the upper iron and the lower iron.

When this prior art trouser-pressing machine is operated, an operator sets one trouser leg between the middle iron and the lower iron and sets the other trouser leg between the middle iron and the upper iron. Then, the upper iron is pushed against the lower iron through the middle iron. Accordingly, applying the prior art machine, it is possible to press both trouser legs at a time.

However, the middle iron of the prior art machine has been formed entirely in the same thickness up to its portion corresponding to the crotch of the trouser.

Due to this fact, in the case of the prior art machine, it has not been avoided to remain an iron mark at the crotch of the trouser by a right-angle edge of the middle iron corresponding to the crotch of the trouser.

As a result, application of the prior art trouser-pressing machine has showed a problem that the crotch of the trouser could not be pressed well.

In view of the problem of the prior art described above, the present invention has been provided.

Accordingly, a technical theme to be solved by the present invention is to provide the middle iron formed to enable the mark of the iron to be prevented from being left at the crotch of the trouser and the crotch of the trouser to be pressed well and to provide a cover used while being applied over the middle iron.

SUMMARY OF THE INVENTION

The middle iron of the present invention, as shown in FIG. 1 and the like, is provided between the upper iron and the lower iron. One leg of a trouser is set between the middle iron and the lower iron. The other leg of the trouser is set between the middle iron and the upper iron. Both legs of the trouser are held by the upper iron, the middle iron and the lower iron and are pressed at a time.

At the middle iron, in one side end part which the crotch of the trouser being set on, only a portion corresponding to the crotch is formed to tapered shape gradually thinning toward the side of the middle iron.

In addition, a cover for use of the middle iron is also formed as shows in FIG. 1 and the like. That is, in one side end part of the cover which the crotch of the trouser being set on, only a portion corresponding to the crotch is formed to tapered shape gradually thinning toward the side part of the cover. Then, the cover has gussets which are formed becoming narrow toward a portion corresponding to the crotch of the trouser at peripheral surfaces of corner parts formed by one side end part and forward and rearward side end parts of the cover. By effect of these gussets, it is possible to prevent wrinkles occurring in the cover and remaining at the crotch of the trouser Usually, the cover is fitted to the middle iron by a hook-and-loop fastener (refer to FIG. 7 and FIG. 8) or a string, and the like, and the fitting manner of the cover is optional.

In addition, as shown in FIG. 1 and FIG. 8, the cover is formed to a flat bag to enclose the middle iron, and a fitting port for covering over the middle iron is formed at its peripheral side extending in a peripheral direction. It is preferable that the fitting port is formed to be openable or closable by a set of male and female hook-and-loop fastener.

Since this arrangement, it is possible to exchange the cover easily and smoothly.

Applying the middle iron of present disclosure that is formed in such a way as above, it is possible to prevent remaining the mark of the iron at the crotch of the trouser and to get the crotch of the trouser be pressed well.

In addition, applying the cover of present disclosure, because it fits the middle iron, it is possible to get the crotch of the trouser be pressed well without remaining the mark of iron.

REFERENCE TO DRAWINGS

DESCRIPTION OF PREFERABLE EMBODIMENT

Referring now to the accompanying drawings, one preferred embodiment of the present invention will be described as follows.

Figure 1A:
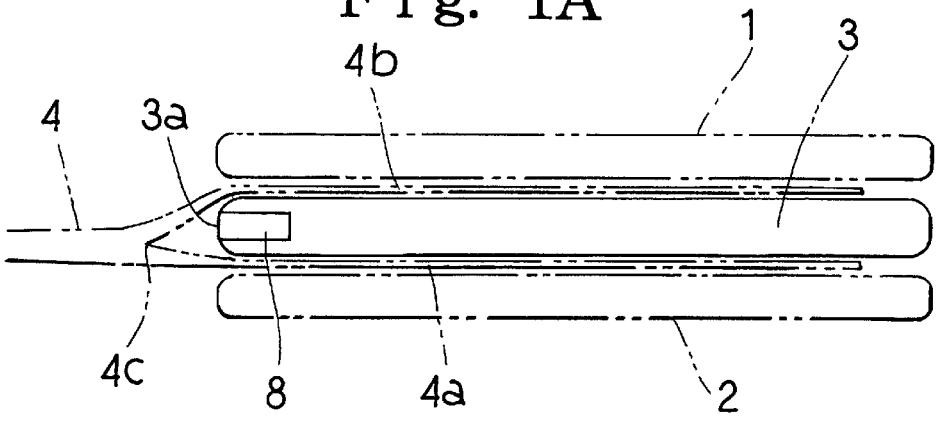
FIG. 1A is a front view of a state as piled of the upper iron, the middle iron, and the lower iron.
Figure 1B:
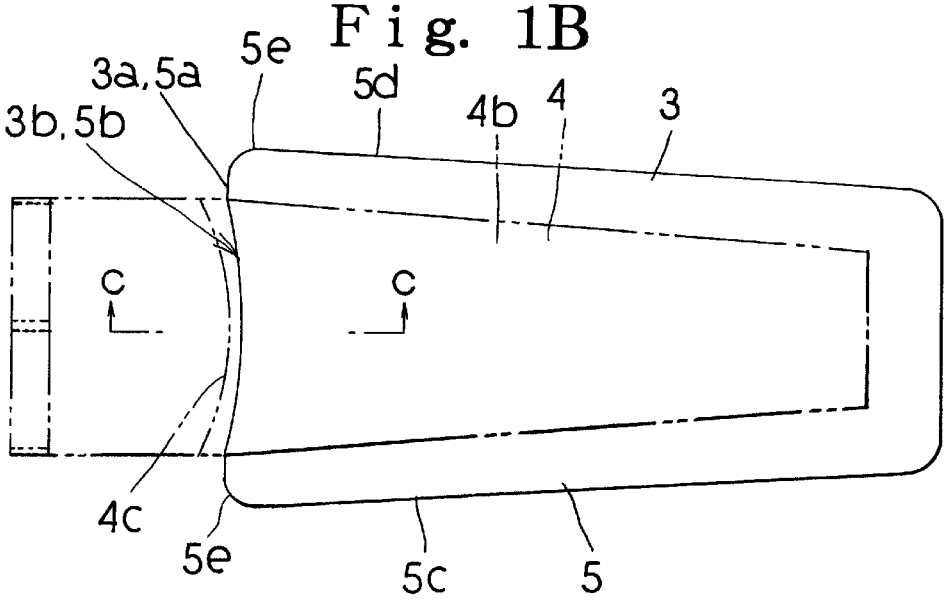
FIG. 1B is a flat view of the middle iron.
Figure 1C:
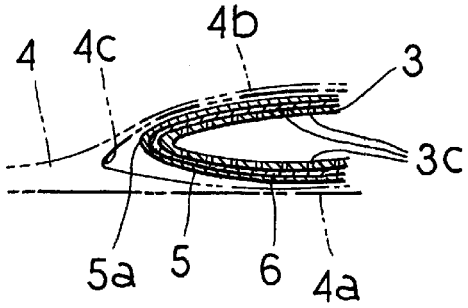
FIG. 1C is an enlarged cross sectional view of a line C-C in FIG. 1B.
Figure 2:
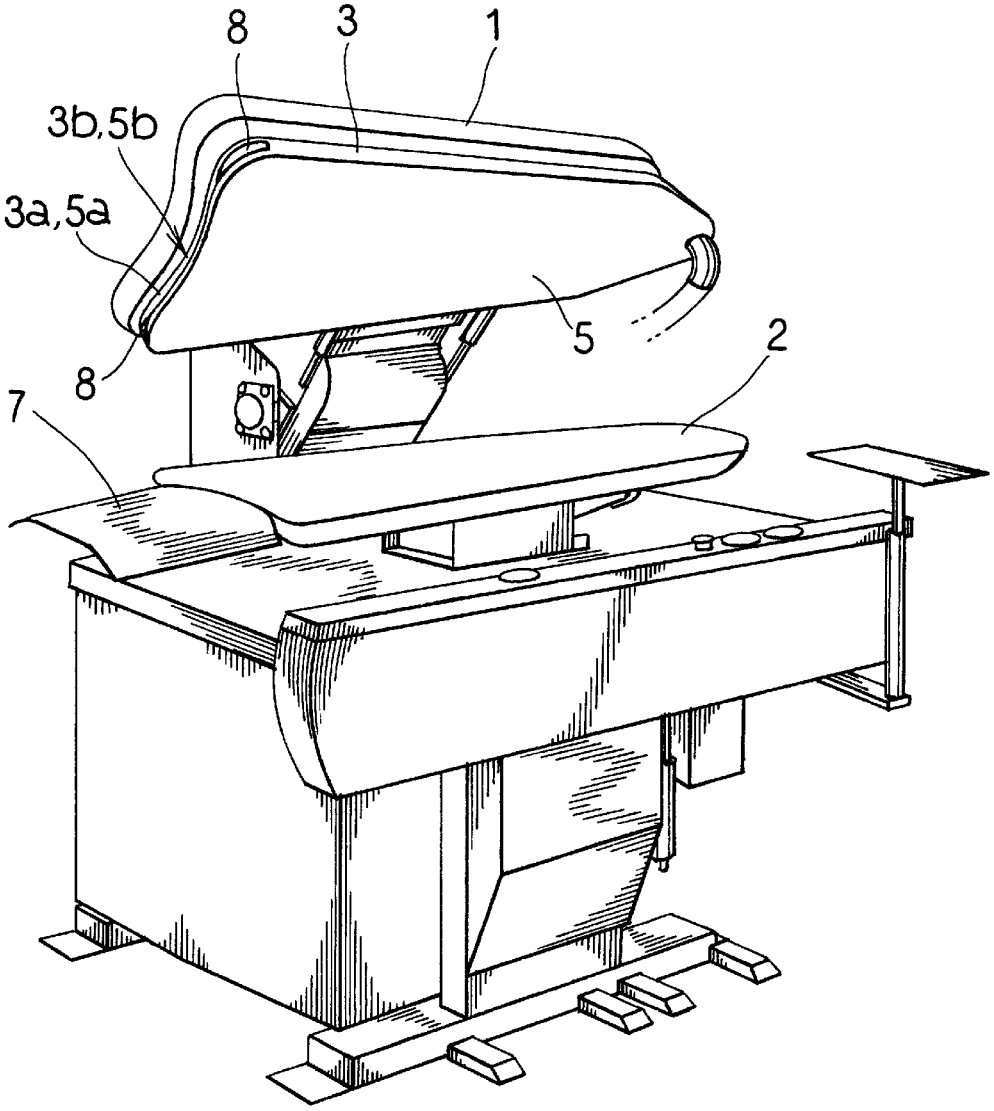
FIG. 2 is a prospective view of the trouser-pressing machine.

In FIG. 1, FIG. 2 and the like, a word number 1 is the upper iron and a word number 2 is the lower iron. The middle iron 3 of this invention is provided between the upper iron 1 and the lower iron 2. One leg 4*a* of the trouser 4 is set between the middle iron 3 and the lower iron 2. The other leg 4*b* is set between the middle iron 3 and the upper iron 1.

Both legs 4*a*, 4*b* of the trouser 4 are held by the upper iron 1, the middle iron 3 and the lower iron 2, and are pressed at a time by the operation that the upper iron 1 is presses against the lower iron 2 through the middle iron 3.

In the case of this embodiment, the upper iron 1 and the lower iron 2 are formed to turn on the steam. In addition, the lower iron 2 is formed to have a vacuum function capable of sucking a skirt and the like in ironing them.

Figure 3:
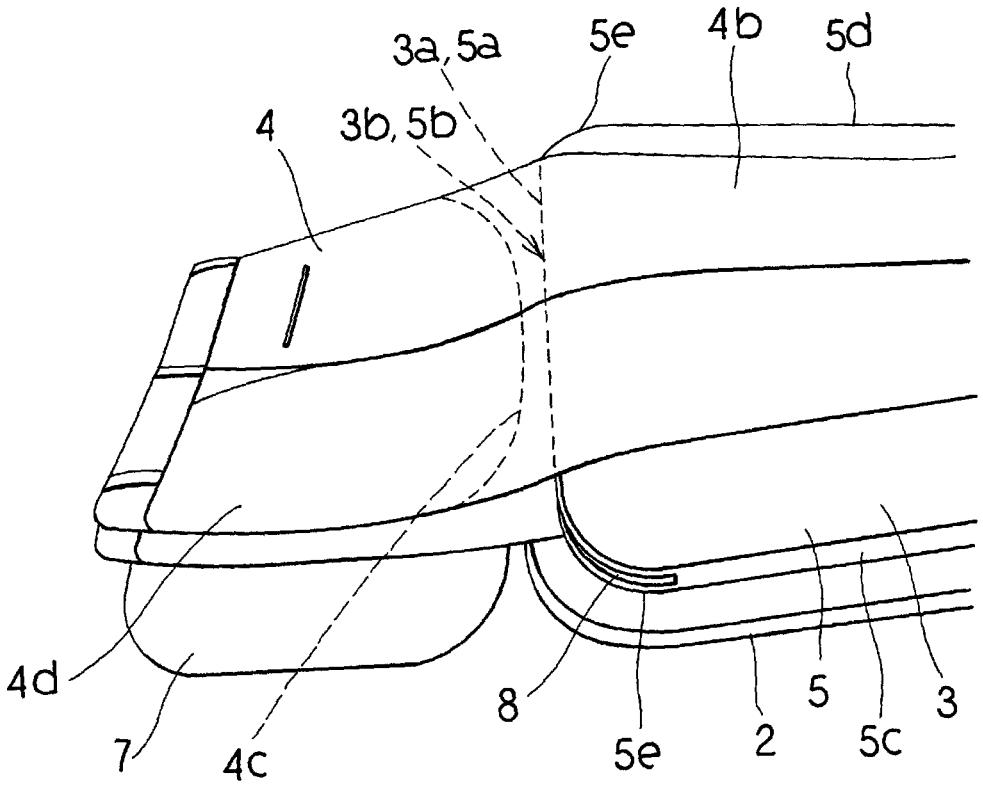
FIG. 3 is a main part prospective view of using state of the trouser-pressing machine.

The crotch 4*c* of the trouser 4, as shown in FIG. 1 and FIG. 3, is set on one side end part 3*a* of the middle iron 3.

The middle iron 3, in one side end part 3*a*, only the portion 3*b* corresponding to the crotch 4*c* of the trouser 4 is formed to tapered shape gradually thinning toward the side of the middle iron. Accordingly, applying the middle iron 3 of the present disclosure, it is possible to get the crotch 4*c* of the trouser 4 be pressed well without remaining the mark of the iron.

Figure 7:
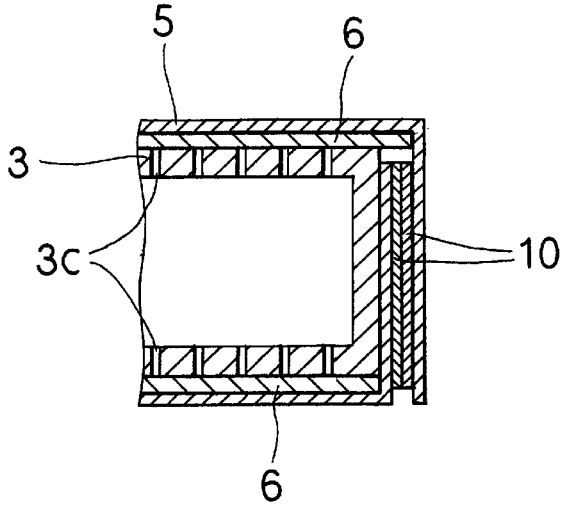
FIG. 7 is a main part enlargement cross sectional view of a line VII-VII in FIG. 6.

The middle iron 3, as shown in FIG. 1C and FIG. 7, is formed to have suction holes 3*c* severally at an upper plate and a lower plate and its inside part is formed like a hollow shape. The suction holes 3*c* are formed also in the portion 3*b* which is formed in tapered shape of the middle iron 3.

The middle iron 3 is formed to be connected to an external sucking machine (not shown) and its inside part is capable of exhausting. With this arrangement as above, both legs 4*a*, 4*b* of the trouser 4 are sucked against upper plate and under plate of the middle iron 3 with the cover 5 and plane cushion materials 6. In this case, the crotch 4*c* of the trouser 4 is sucked against the tapered shape portion.

Accordingly applying the middle iron of the present invention, a setting operation of the trouser 4 is capable easily and smoothly and the crotch 4*c* of the trouser 4 can be pressed under a tightly fixing state.

In the FIG. 3, a word number 7 is a stand for supporting the upper crotch part 4*d* of the trouser 4. The stand 7 is formed to protrude toward a side at a side part of the lower iron 2.

At a cover 5 for use of the middle iron 3, as shown in FIG. 1 and the like, in one side end part 5*a*, only the portion 5*b* corresponding to the crotch 4*c* of the trouser 4 is formed to tapered shape gradually thinning toward the side part of the cover 5.

Figure 4:
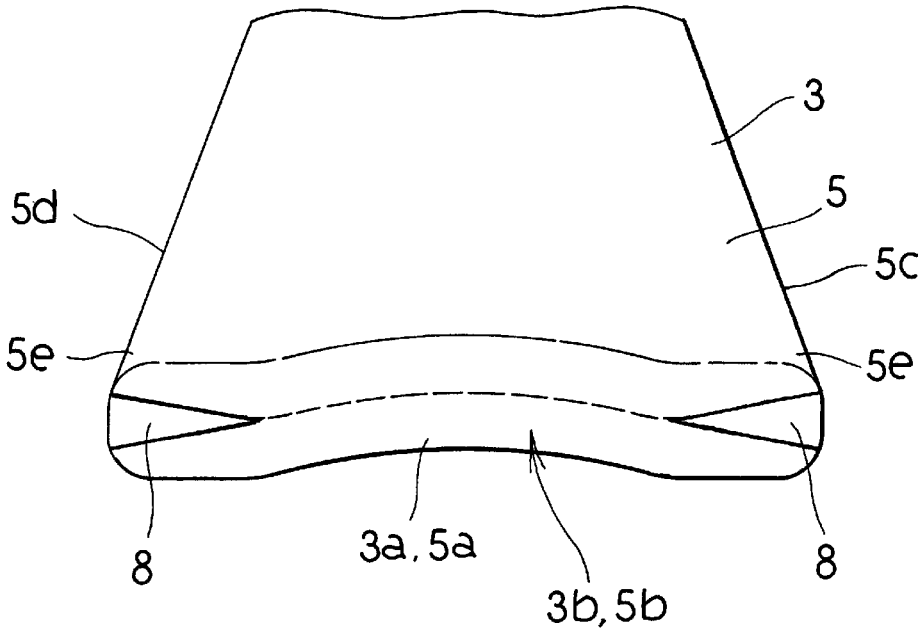
FIG. 4 is a main part prospective view of cutout a part of the middle iron.
Figure 5:
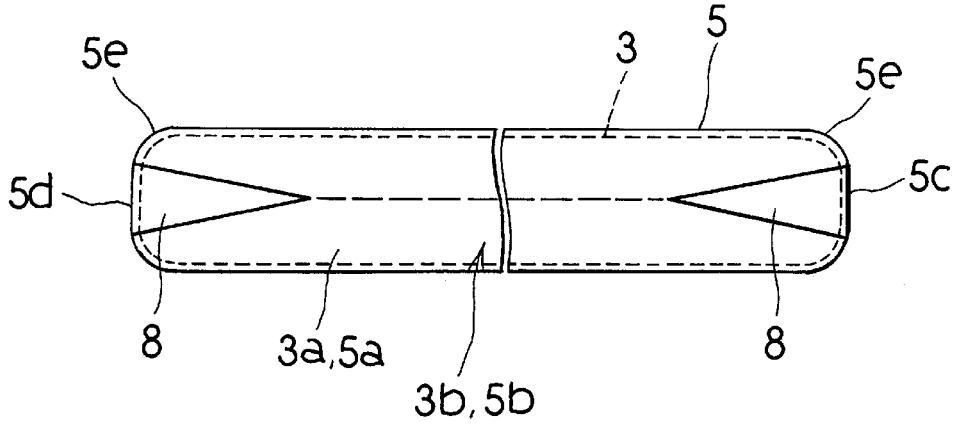
FIG. 5 is a main part side view of cutout a part for explaining to the middle iron and the cover.
Figure 6:
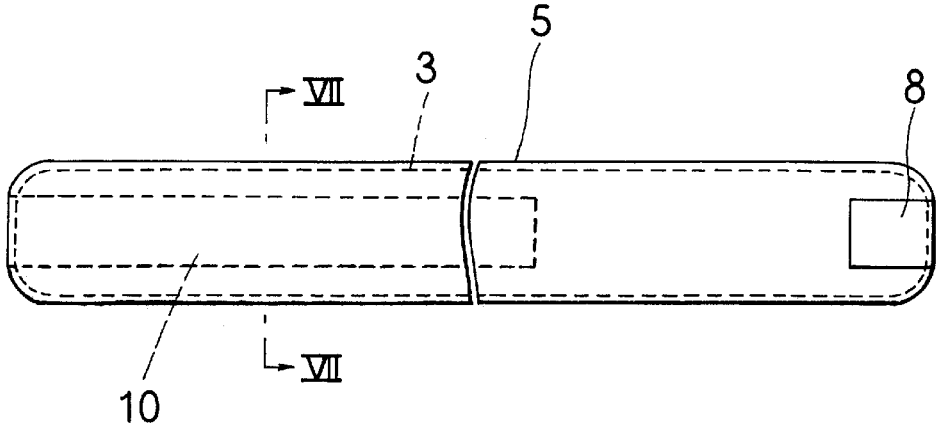
FIG. 6 is a main part behind view of cutout a part for explaining to the middle iron and the cover.

In addition, as shown in FIG. 4 and the like, the cover 5 has the gussets 8 at the peripheral surfaces of the corner parts 5*e* which are formed by one side end part 5*a* and forward and rearward side end parts 5*c*, 5*d* of the cover 5. The gussets 8, as shown in FIGS., are formed becoming narrow toward the portion 5*b* corresponding to the crotch of the trouser. A material of the gussets 8 is clothes having the same aeration quality as that of the cover.

Additionally, the cover 5 is formed to a flat bag to enclose the middle iron 3. In addition, the cover 5 has the fitting port 9 (refer to FIG. 8) for covering over the middle iron 3 at its peripheral side. The fitting port 9 is formed extending in the peripheral direction of the cover 5 and is formed to be openable or closable by a set of male and female hook-and-loop fastener 10. The hook-and-loop fastener 10 is provided longitudinally along a direction forming the fitting port 9.

It is described that the operation of the present invention follows.

At first, as shown in FIG. 1A and the like, the operator sets one leg 4*a* of the trouser 4 on the upper surface of the lower iron 2. And next, the operator the middle iron 3 is lowered and sets the other leg 4*b* of trouser 4 on the upper surface of the middle iron 3. In this case, the trouser legs 4*a*, 4*b* are sucked against the middle iron 3.

Then, the upper iron 1 is pressed against the lower iron 2 with the middle iron 3 only for a predetermined time. In this case, the legs 4*a*, 4*b* of the trouser 4 are pressed with steaming by the upper iron 1 and the lower iron 2 turning on the steam.

At the middle iron 3, as described above, only the portion 5*b* corresponding to the crotch 4*c* of the trouser 4 is formed in tapered shape. Accordingly by the present invention, when the pressing pressure of the upper iron 1 is applied to the trouser 4, the mark of the iron by the upper iron 1 and the lower iron 2 does not remain at the crotch 4*c* of the trouser 4.

Figure 8:
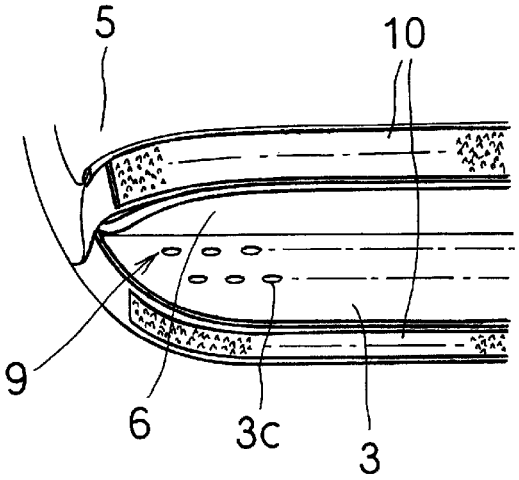
FIG. 8 is a main part prospective view as shows a fitting port of the cover.

When exchanging the cover 5, as shown in FIG. 8, at first, the operator opens the fitting port 9, and next, the cover 5 removes from the middle iron 3, and exchanges it with a new cover. In this case, the cover 5 is capable of exchanging with a new one simply and rapidly since the fitting port 9 is capable of open or close by a hook-and-loop fastener 10.

With the arrangement as above, the forming manner of the portion 3*b* corresponding to the crotch 4*c* of the trouser 4 is optional as long as it is formed to tapered shape.

Although in the described above, the upper plate and the lower plate of the middle iron 3 are formed to tapered shape by themselves, however, it may also be applicable that, for example, if they could be realized by connecting different members of tapered shape.

In the case of above embodiment, although the tapered shape part is formed to a curved-shape slightly in order to lessen the pressure of the upper iron 1 and the lower iron 2, however, the present invention is not limited to a case in which the shape of the iron is formed to that described above. That is, it may also be applicable that the tapered shape part of the middle iron 3 is formed to a plane shape, and is capable to lessen the pressure of the upper iron 1 and the lower iron 2 by the plane cushion materials 6.

The invention claimed is:

1. A middle iron of a trouser-pressing machine of a type in which the middle iron is provided between an upper iron and a lower iron, one trouser leg is set between the lower iron and the middle iron, the other trouser leg is set between the upper iron and the middle iron, and both trouser legs are held by the upper iron, the middle iron and the lower iron and pressed at a time characterized in that in one side end part which the crotch of the trouser setting on, only the portion corresponding to the crotch is formed to tapered shape gradually thinning toward the side of the middle iron, characterized in that only the portion corresponding to the crotch is formed to tapered shape gradually thinning toward the side of the cover in one side end part which the crotch of the trouser setting on, and further characterized in that the cover has gussets which are formed becoming narrow toward a portion corresponding to the crotch of the trouser at peripheral surfaces of corner parts formed by one side end part and forward and rearward side end parts of the cover.

2. The middle iron of a trouser-pressing machine according to claim 1 characterized in that its inside part is formed like a hollow shape, several suction holes are formed at an upper plate and a lower plate and the suction holes are also formed at the portion corresponding to the crotch of the trouser.

3. The cover for use of the middle iron of the trouser-pressing machine according to claim 1 characterized in that the cover is formed to a flat bag to enclose the middle iron and is formed to have a fitting port for covering over the middle iron at the peripheral side extending in a peripheral direction.

4. The cover for use of the middle iron of the trouser-pressing machine according to claim 3 characterized in that the fitting port is formed to be openable and closable by a set of male and female hook-and-loop fastener.

5. The cover for use of the middle iron of the trouser-pressing machine according to claim 1 characterized in that the cover is formed to a flat bag to enclose the middle iron and is formed to have a fitting port for covering over the middle iron at the peripheral side extending in a peripheral direction.

* * * * *